US006116871A

United States Patent [19]

Backé et al.

[11] Patent Number: 6,116,871

[45] Date of Patent: Sep. 12, 2000

[54] DEVICE TO REDUCE PULSATIONS ON A HYDROSTATIC POSITIVE DISPLACEMENT UNIT

[75] Inventors: Wolfgang Backé, Aachen; Alfred Langen, Grossostheim; Marcus Jarchow, Aachen, all of Germany

[73] Assignee: Linde Aktiengesellschaft, Germany

[21] Appl. No.: 09/024,027

[22] Filed: Feb. 16, 1998

[30] Foreign Application Priority Data

Feb. 17, 1997 [DE] Germany ..... 197 06 116

[51] Int. Cl.[7] ..... F04B 11/00; D01B 13/04

[52] U.S. Cl. ..... 417/540; 60/469; 91/487; 91/489

[58] Field of Search ..... 417/540, 543, 417/269; 92/71; 91/486, 487, 489, 499; 60/469

[56] References Cited

U.S. PATENT DOCUMENTS

| | | | |
|---|---|---|---|
| 2,474,512 | 6/1949 | Bechtold et al. | 417/540 |
| 3,804,125 | 4/1974 | Sonneman | 417/540 |
| 3,956,969 | 5/1976 | Hein | 91/487 |
| 5,171,134 | 12/1992 | Morgart et al. | 417/540 |
| 5,538,401 | 7/1996 | Schaffner et al. | 417/269 |
| 5,572,919 | 11/1996 | Ishizaki | 91/499 |

*Primary Examiner*—Charles G. Freay
*Attorney, Agent, or Firm*—Webb Ziesenheim Logsdon Orkin & Hanson, P.C.

[57] ABSTRACT

This invention relates to a device to reduce pulsations on a hydrostatic positive displacement unit, such as an axial piston machine or a radial piston machine which can be used both as a pump and as a motor. The direction of rotation of the positive displacement unit is reversible and at least one piston is mounted so that it can move longitudinally in a cylinder bore forming a cylinder chamber. The device has a buffer element which can be brought into communication with the cylinder chamber by a connecting channel. It is possible to further optimize the reversing action of the cylinder chambers from the inlet side to the outlet side and to effectively minimize pulsations in a broad bandwidth of operating conditions by increasing the capacity of the buffer element compared to the capacity of an oil-filled buffer element and/or by providing at least one additional connecting channel which connects the cylinder chamber with the buffer element or with a control nodule of the positive displacement unit, whereby a throttling device is located in the other connecting channel. The buffer element may be a hydropneumatic buffer.

12 Claims, 4 Drawing Sheets

DEVICE TO REDUCE PULSATIONS ON A HYDROSTATIC POSITIVE DISPLACEMENT UNIT

BACKGROUND OF THE INVENTION

1. Field of the Invention

This invention relates to a device to reduce pulsations on hydrostatic positive displacement units which are either axial or radial piston machines used both as a pump and as a motor, with a reversible direction of rotation. In these displacement units at least one piston is mounted so that it can move longitudinally in a cylinder bore forming a cylinder chamber. The device of the present invention has a buffer element which is in communication with the high pressure side of the displacement unit and which can be brought into communication with the cylinder chamber of the displacement unit.

2. Background Information

Hydrostatic positive displacement units generally have a plurality of cylinder chambers and deliver a non-constant, pulsating volume flow. One of the causes of these pulsations in the flow of the positive displacement unit is the result of the kinematic conditions. On a pump, the hydraulic fluid is transported by several pistons movable longitudinally in cylinders and work according to the positive displacement principle from the low pressure inlet side to the high pressure outlet side. As a result of the superimposition of the individual volume flows to form the total volume flow of the positive displacement unit, there is a pulsation in the flow being transported. This type of pulsation is designated a kinematic pulsation.

An additional cause of the pulsations is the kinetic pulsation which originates from the compressibility of the medium being transported, and which occurs primarily when there are large pressure differentials between the inlet side and the outlet side. This type of pulsation is caused by pressure equalization currents which occur during the reversal actions of the cylinder chambers from the inlet side to the outlet side. If, for example, a cylinder chamber of a rotating cylinder drum is moved from the low pressure inlet side to the high pressure outlet side at the corresponding dead center position of the movement of the piston, the cylinder chamber traverses an area in which the cylinder chamber is briefly not in communication with either the low pressure side or the high pressure side. When communication is subsequently established between the cylinder chamber and the high-pressure side, volume flows occur as a result of the pressure differential between the cylinder chamber and the high-pressure side. As the cylinder chambers move further, the cylinder chamber also traverses an area in which the cylinder chamber is not connected to the high-pressure side or the low-pressure side. Large pressure differentials also occur when the cylinder chamber is in communication with the low-pressure side. Consequently, pulsations originate which result in vibrations and noises in the positive displacement unit.

To reduce pulsation, the prior art discloses the use of a buffer element which effects an equalization between the pressure in the cylinder chambers and the pressure on the high-pressure side.

A hydrostatic axial piston machine with such a buffer reversal is described in DE 42 29 544. On the machine, there is a buffer element in the form of an oil-filled pre-compression space which is placed in communication with the cylinder chamber after the cylinder chamber has passed the dead center position by means of a connecting channel and an opening in the control plate. Hydraulic fluid is thereby extracted from the pre-compression space, as a result of which the pressure in the cylinder increases. The pre-compression space is filled via a line which is in communication with the high-pressure side of the machine.

The pre-compression space is supplied with fluid via a constant connection between the pre-compression space and the outlet side of the machine. If a cylinder space moves from the inlet side to the outlet side, and if low pressure is applied to the inlet side and high pressure to the outlet side, hydraulic fluid is extracted from the pre-compression space as soon as the cylinder chamber has exposed the opening in the control plate. As a result of this measure, the pressure in the cylinder chambers is equalized to the pressure of the outlet side, whereupon lower volume flows are formed to equalize the small remaining pressure difference when the cylinder chambers are connected to the outlet side. With this measure, however, a specially designed cylinder nodule is required to connect the cylinder chambers with the pre-compression space, to make it possible for the hydraulic fluid to flow rapidly from the pre-compression volume into the cylinder chamber.

The prior art also includes the recharging of the pre-compression space during the period in which the cylinder space is in communication with the high-pressure side. To fill the pre-compression space, therefore, only a temporary communication with the high-pressure side is established. For this purpose, a specially shaped cylinder nodule is required. While the cylinder chamber is in communication with the pre-compression volume, this cylinder nodule first briefly establishes communication between the cylinder chamber and the pre-compression space by means of a connecting channel. During this period, the pressure in the cylinder is increased. As the cylinder chamber moves farther toward the outlet side, the communication between the cylinder chamber and the buffer element is interrupted. In a further phase, an increasingly large cross section is formed which makes it possible to fill the pre-compression space as soon as the cylinder is in communication with the high-pressure side and the connecting channel.

The volume flow which is required to fill the pre-compression space is defined by a throttle which is located in a channel which connects the pre-compression space with the cylinder chamber. The selection of the throttle has a significant influence on the pulsation action of the positive displacement unit. With a severe throttling, the volume current which flows to the pre-compression space will be small, and thus the pre-compression space is not filled at the pressure applied on the high-pressure side. As a result, the volume flow into the cylinder chambers will also be small, which means that the pressure equalization of the cylinder chambers will be insufficient. If the throttling of the volume flow is small, the pre-compression space can no longer be considered a pilot element, but forms a part of the high-pressure side, as a result of which the pulsation-reducing action is lost. The selection of the throttle used to fill the pre-compression volume is therefore also determined by the volume flow flowing from the pre-compression space to the cylinder chamber, and by the pulsation behavior of the positive displacement unit.

In these measures with a buffer reversal, the cylinder chamber is placed in communication with the pre-compression space only briefly. Only a short period of time is therefore available for the required pressure equalization. The time during which the cylinder chamber is in communication with the space via the connecting channel is controlled by the geometry of the connecting line and of the cylinder nodule. The optimum opening time must thereby be considered the time in which a pressure equalization can take place between the cylinder chamber and the pre-compression space. This opening time, however, is a function of the operating parameters, such as the speed of rotation, the operating pressure and the displacement position. The opening time with these measures is defined, however, by the geometry of the components, which means that an effective reduction of pulsations is not achieved under all operating conditions.

SUMMARY OF THE INVENTION

The object of this invention is to make available a device to reduce pulsations on hydrostatic positive displacement units, so that the reversing processes of the cylinder chambers can be optimized, and the pulsations can be effectively minimized in a broad bandwidth of operating conditions.

The invention provides a switchable valve, in particular a non-return valve which opens toward the cylinder chamber, in a channel connecting the buffer element with the cylinder chamber.

The hydraulic medium required for compression and pressure equalization of the cylinder chambers to the pressure on the outlet side is taken from the buffer element. The switchable valve may be a non-return valve to thereby make available a large flow cross section for filling the cylinder chambers. As soon as a pressure equalization between the cylinder chamber and the buffer element has been established, the non-return valve switches into the closed position. The connection between the cylinder chamber and the buffer element therefore remains open only until a pressure equalization has been established. The opening time of the connection is not controlled by the geometry of the components, but by the valve. The pressure equalization is therefore independent of the operating parameters, e.g. the speed of rotation, the operating pressure and the displacement position. When the device of the present invention is used in a positive displacement unit with an adjustable displacement volume which works against pressures which are not constant, an effective reduction of pulsations becomes possible. Consequently, less noise and fewer vibrations occur on a positive displacement unit. An additional advantage is that the cylinder nodules do not require any particular structural configuration, because the opening time of the connection between the cylinder chambers and the buffer element is controlled by the valve. The result is a simpler and more economical structure of the cylinder nodules.

In one configuration of the invention, the connecting channel has two channel segments oriented in parallel, whereby the non-return valve is located in one channel segment and a throttling device is located in the second channel segment. As a result of the parallel arrangement of a non-return valve and a throttle, a large flow cross section is available to fill the cylinder chamber in the one flow direction from the buffer element to the cylinder chamber. In the other direction of flow, it is possible to fill the buffer element via the throttle. The volume flow for the pressure equalization of the cylinder chambers is therefore independent of the volume flow required to fill the buffer element, as a result of which there is no dependence on the size of the throttle for filling the buffer element. Consequently, and in particular on positive displacement units on which the buffer element is in intermittent communication with the high-pressure side, an improved pulsation action is achieved. An additional advantage is that the throttle for filling the buffer element and the non-return valve for equalizing the pressure in the cylinder chambers can be combined into a single component, namely a one-way restrictor valve. The result is a simpler construction of the device. A one-way restrictor valve also makes possible a flow of hydraulic fluid from the cylinder chamber into the buffer element. Consequently, for example on a pump which is operated under certain conditions as a motor, the reversal actions are also improved, because when there is a movement of the cylinder chambers, hydraulic fluid can flow from the inlet side, which under these operating conditions is under high pressure, to the outlet side which is under low pressure, out of the cylinder chambers into the buffer element. Consequently, there is a reduction of the pressure in the cylinder chambers, whereupon the pressure differentials during reversal from the high-pressure side to the low-pressure side are also reduced. The buffer element for operation of the unit as a pump can therefore also improve the operation of the unit as a motor.

It is particularly advantageous if the capacity of the buffer element is increased compared to the capacity of an oil-filled buffer element. The pulsation-reducing effect of a buffer element increases with the capacity of the buffer element. To effectively reduce the pulsations, it would therefore be necessary to provide the buffer element with a corresponding large volume of hydraulic fluid. The capacity of a buffer element is a function of the volume and the modulus of compression of the media it contains. It therefore becomes possible to increase the capacity of the buffer element by changing the modulus of compression. It thereby becomes possible, with the same damping and thus pulsation-reducing action, to reduce the amount of space required for the installation of the buffer element of the present invention compared to an oil-filled buffer element. Additionally, given an installation space of the same size, an increase in capacity results in the improved reduction of pulsations.

In one configuration of the invention, the buffer element is a hydropneumatic buffer. The hydropneumatic buffer may be a gas buffer with a membrane which separates the space containing oil from the space containing the gas. As a result of the use of a hydropneumatic buffer, the capacity of the buffer element is increased compared to the capacity of an oil-filled buffer element. It is therefore possible to install a buffer element with a larger capacity in a specified amount of space. Consequently, the pulsation-reducing effect of the buffer element is increased. It is also possible to reduce the amount of space required compared to the space required for an oil-filled buffer element, whereby the same capacity of the buffer element and thus the same pulsation-reducing effect can be achieved.

It is also possible to increase the capacity of the buffer element if the buffer element has an oil-filled space with a flexible containment wall. A further increase in the capacity is hereby achieved if the flexible containment wall of the buffer element is under a gas pressure from a surrounding chamber.

In a further configuration of the invention, the buffer element has an oil-filled space, whereby flexible elements, such as plastic elements, are inserted into the space. This arrangement also makes it possible to increase the capacity of the buffer element, as a result of which there is an improved reduction of pulsations.

In a further configuration of the invention, the invention teaches that to optimize the reversing actions, there is at least one additional connecting channel which connects the cylinder chambers with the buffer element and a throttling device is located in the connecting channel.

As a result of the reversal via a plurality of connecting channels, a further improvement of the reversal is achieved. As a result of this measure, it becomes possible to increase the length of time which is available for the pressure equalization between the cylinder chamber and the buffer element, so that an effective damping of pulsations becomes possible in a broad bandwidth of operating parameters. The filling action of the buffer element can also be influenced by the use of a plurality of throttling devices. The throttling device may be an orifice. It is also possible, however, to use a throttle boring.

It is further advantageous to apply pressure to the valve in the closing direction by the force of a spring. This measure guarantees that the non-return valve will remain in the closed position during a pressure equalization between the cylinder chamber and the buffer element.

The invention can be used both in positive displacement units which employ the axial piston design with a rotating cylinder drum, such as an axial piston machine with an oblique plate or swashplate, and also in positive displacement units with a rotating control plate, which are sometimes called swashplate or wobble plate machines. The invention can also be used in radial piston machines both with internal and also with external pressurization.

Additional advantages and details of the invention are explained in greater detail below with reference to the embodiments which are illustrated in the accompanying schematic drawings.

DETAILED DESCRIPTION OF THE PREFERRED EMBODIMENTS

Figure 1:
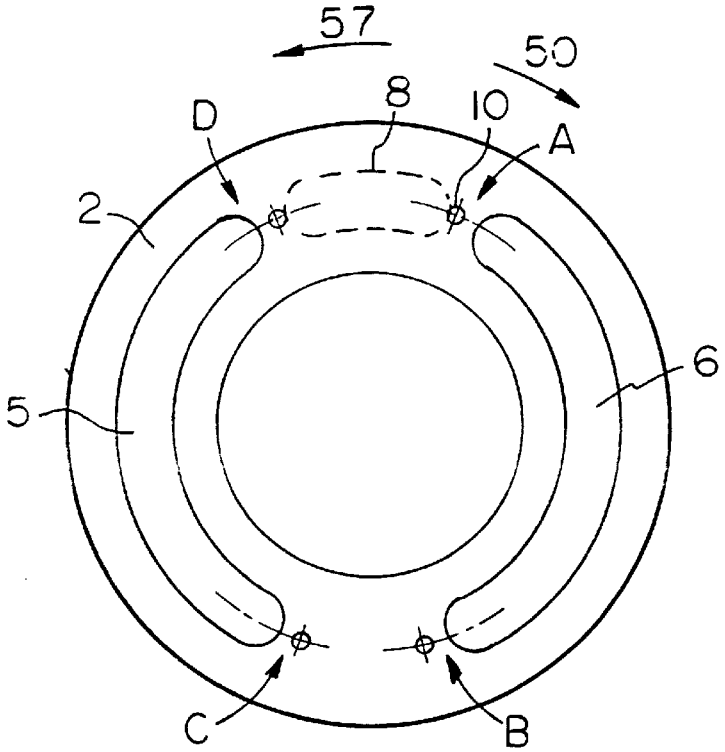
FIG. 1 is a schematic plan view of a control plate of an axial piston machine.

FIG. 1 is a schematic plan view through a control plate 2 of an axial piston machine with two control nodules 5, 6, each of which can be brought into communication with the low-pressure side and the high-pressure side of a hydraulic circuit, as a result of which the positive displacement unit can be operated both as a pump and as a motor. The cylinder chambers of the axial piston machine, on the side facing the control plate 2, each have a kidney-shaped control slot 8 which is in alternating communication with the control nodules 5, 6 as a result of the rotational movement of the cylinder drum relative to a stationary control plate 2 or the movement of the control plate 2 relative to a stationary cylinder drum. When the cylinder drum moves in the direction 50, the cylinder chamber moves from the control nodule 5, forming the low-pressure side of a hydrostatic circuit, to the control nodule 6 forming the high-pressure side. If the control nodule 5 is the hydraulic fluid inlet and the control nodule 6 a hydraulic fluid outlet, the positive displacement unit works as a pump. If, with the same hydraulic fluid inlet and hydraulic fluid outlet, the control nodule 5 is connected to the high-pressure side and the control nodule 6 to the low-pressure side of the circuit, the positive displacement unit is operated as a motor. A reversal of the direction of rotation can also be made by moving the cylinder drum and thus of the cylinder chambers in the direction 51. In that case, the control nodule 6 represents the hydraulic fluid inlet and the control nodule 5 the hydraulic fluid outlet. When the control nodules 5, 6 are pressured accordingly with high pressure and low pressure, the result is also operation as a pump and as a motor. A reversal in the direction of rotation can also be made on an axial piston machine which is operated in only one direction of rotation by pivoting a swashplate around the center axis which lies perpendicular to the axis of rotation.

In the vicinity of the web which separates the control nodules 5 and 6, in the area A of the control nodule 6 there is a connecting channel 10 which is in communication with a buffer element. In a pump which is operated in the direction 50 and sucks hydraulic fluid out of the control nodule 5 and transports it into the control nodule 6, the hydraulic fluid is compressed in the cylinder chamber to approximately the pressure at the control nodule 6, as soon as the control slot 8 exposes the connecting channel 10 in the control plate 2. The reversing action from the low-pressure side to the high-pressure side is thereby improved. For such a positive displacement unit operating in single-quadrant operation, it is sufficient to locate one buffer element between the low-pressure control nodule and the high-pressure control nodule. A buffer element can be in the same location when the positive displacement unit is operated as a motor. it If the pump, with the same direction of rotation, is also used as a motor for example, in which case the control nodule 6 is pressurized with low pressure and the control nodule 5 with high pressure, in area C of the control nodule 5, there is a corresponding connecting channel with a buffer element, to improve the reversal of the cylinder chambers from the low-pressure side to the high-pressure side. If the positive displacement unit also has a swashplate which can be adjusted by means of the center position, the inlet side and the outlet side are thereby switched, and the direction of rotation is reversed. With the buffer elements located in areas A and C, the reversing action for such a positive displacement unit which is working in four-quadrant operation is thereby also improved from the low-pressure side to the high-pressure side. If, on a positive displacement unit, the cylinder chambers are moved in the direction 51 to reverse the direction relative to the control plate 2, there are additional corresponding buffer elements in the areas B and D, to make it possible to reduce pulsations for four-quadrant operation of the positive displacement unit.

Each of the two or four buffer elements of a positive displacement unit working in four-quadrant operation is the same as the single buffer element of a positive displacement unit working in single-quadrant operation. The following description relates to the location of a buffer element in the area A of the control nodule 6. The buffer element, however, can also be located in areas B, C or D, or in a plurality of areas, depending on the manner in which the positive displacement unit is operated.

Figure 2:
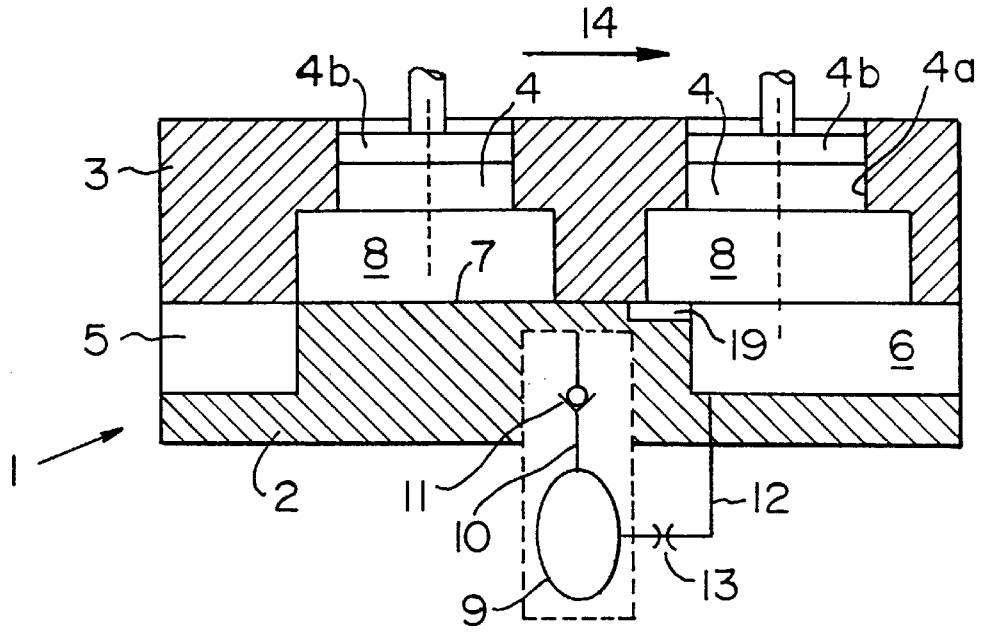
FIG. 2 shows a cross-section through a control plate with a schematic view of a buffer element and the connection according to the present invention between the buffer element and the cylinder chambers.

FIG. 2 shows a cross-section through an axial piston machine with a control plate 2 and a cylinder drum 3. The cylinder drum 3 has a plurality of cylinder bores 4*a* which form cylinder chambers 4 in which pistons 4*b* are mounted so that they can move longitudinally. On the control plate 2 there are control nodules 5, 6 wherein the inlet side for hydraulic fluid is in communication with the low-pressure side of a hydraulic circuit. The outlet side, formed by the control nodule 6, is pressurized at high pressure. The axial piston machine therefore works as a pump. If the low-pressure side is in communication with an unpressurized container, the pump works in an open circuit.

When the cylinder drum 3 moves relative to the control plate 2, either by a rotation of the cylinder drum 3 in the direction 14 relative to a stationary control plate 2, or by the rotation of the control plate 2 relative to the stationary cylinder block 3, the cylinder chambers 4 are alternately placed in communication with the low-pressure control nodule 5 and the high-pressure control nodule 6 of the control plate 2. Between the control nodules 5 and 6 there is a web 7 which separates the two control nodules 5, 6 and is located in the vicinity of the dead center positions of the longitudinal movement of the pistons. The cylinder chambers 4, on the side facing the control nodules 5, 6, have control slots 8 which can be kidney-shaped.

Between the control nodules 5 and 6 there is a buffer element, the purpose of which is to damp pulsations by equalizing the pressure of the fluid in the cylinder chambers 4 to the pressure on the high-pressure control nodule 6.

A connecting channel 10 extends from the buffer element 9 to the web 7 of the control plate 2. In the connecting channel 10 there is a non-return valve 11 which opens toward the separation web 7 and thus toward the cylinder chamber 4. To refill the buffer element there is a channel 12 which is in constant communication with the high-pressure control nodule of the control plate 2. The channel 12 has a constriction 13 in the form of a throttle, which can be used to influence the volume of the flow required to fill the buffer element 9.

If the cylinder drum 3 moves in the direction 14, for example from the low-pressure side to the high-pressure side of the positive displacement unit 1, in a first phase of the movement fluid flows into the cylinder chambers 4 as soon as the control slots 8 of the cylinder chambers 4 are in communication with the low-pressure control nodule 5. In a further phase of the movement, the control slot 8 of the cylinder closes the connection to the low-pressure control nodule 5. As soon as the control slot 8 exposes the mouth to the connecting line 10, the non-return valve 11 opens, so that hydraulic fluid flows out of the buffer element 9 into the cylinder chamber 4. In this case, the non-return valve 11 makes a large flow cross section available, as a result of which the filling and the pressure equalization of the cylinder chamber 4 occur in a short period of time. Moreover, there is only a small decrease in pressure with a large flow cross section, as a result of which the pressure in the cylinder chamber 4 and the pressure in the buffer element 9 can be equalized to one another without and significant losses. As soon as the pressure between the cylinder chamber 4 and the buffer element 9 has been equalized, the non-return valve 11 switches into the closed position. For this purpose, the non-return valve 11 can have a spring which acts in the closing direction, and guarantees that the non-return valve 11 closes when the pressure is equalized.

As the cylinder drum 3 moves further, the control slot 8 of the respective cylinder chamber 4 comes into communication with the high-pressure control nodule 6, so that the hydraulic fluid contained in the cylinder chambers 4 is transported to the high-pressure side of the positive displacement unit 1. As a result of the equalization of the pressure in the cylinder chambers 4 to the pressure of the buffer, lower equalization flows occur when the cylinder chambers 4 are connected to the control nodule 6. Pulsations are therefore prevented. Consequently, less noise and fewer vibrations occur on the positive displacement unit. The use of pilot notches 19 on the high-pressure control nodule 6 makes it possible to slowly reduce any remaining pressure differential between the cylinder chambers 4 and the high-pressure control nodule 6.

Figure 3:
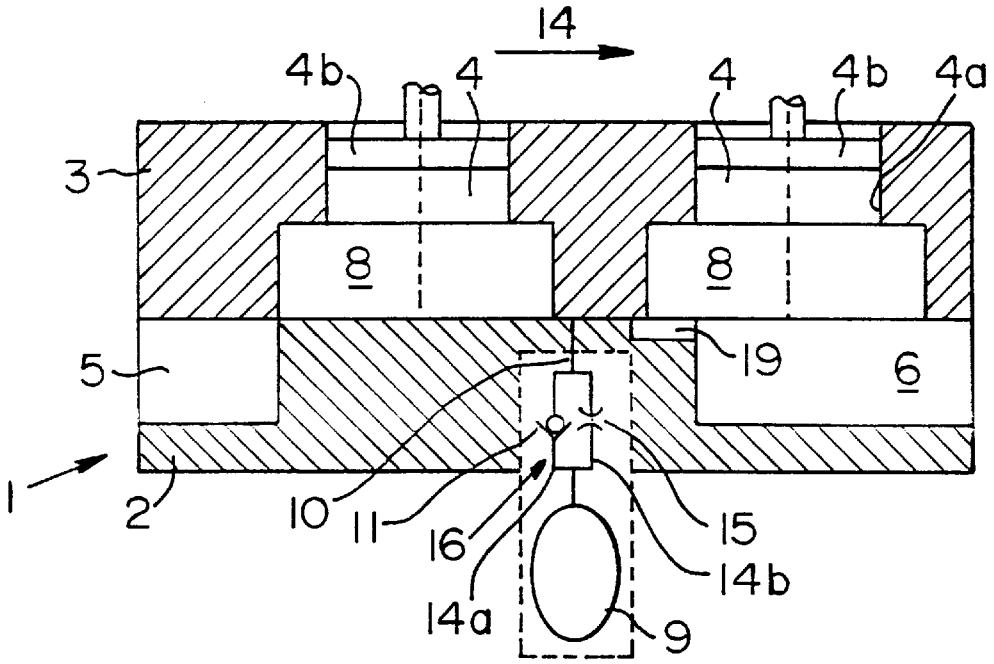
FIGS. 3–5 show views similar to FIG. 2 which are of alternative embodiments of the present invention.

In this embodiment, the channel 12 with the throttle 13 which feeds the buffer 9 is in constant communication with the high-pressure side of the positive displacement unit 1. To reduce the manufacturing costs for the channel 12 and to simplify the installation of the throttle, in a further embodiment of the invention as illustrated in FIG. 3, the connecting channel 10 is divided into two parallel channel segments 14*a* and 14*b*. The non-return valve 11 is located in the channel segment 14*a* and a throttling device 15, e.g. a throttle, is located in channel segment 14*b*. The buffer element 9 is filled via the channel 14*b* and the throttle 15 during the period in which the control slot 8 of the cylinder chamber 4 is in communication with the high-pressure control nodule 6 and the connecting channel 10. The geometry of the control slot 8 and of the control nodules 5, 6 is thereby selected so that the connection between the control slot 8 and the high-pressure control nodule 6 is established shortly after the pressure equalization between the cylinder chamber 4 and the buffer element 9, and therefore shortly after the closing of the non-return valve 11.

The parallel switching of the non-return valve 11 and the throttle 15 also makes it possible to combine these two components to form a one-way restrictor valve 16, which facilitates installation into the control plate 2 of the positive displacement unit 1. If the inlet control nodule 5 is in communication with the high-pressure side of the hydraulic circuit, and the pump is therefore working as a motor, when there is a reversal from the high-pressure side to the low-pressure side, the throttle 15 can also reduce the pressure differential between the cylinder chamber 4 and the outlet control nodule 6, whereby hydraulic fluid flows from the cylinder chamber 4 into the buffer element 9. The buffer element thereby absorbs hydraulic fluid from the cylinder chamber 4, whereupon the pressure in the cylinder chambers 4 is equalized to the pressure on the outlet side.

Figure 4:
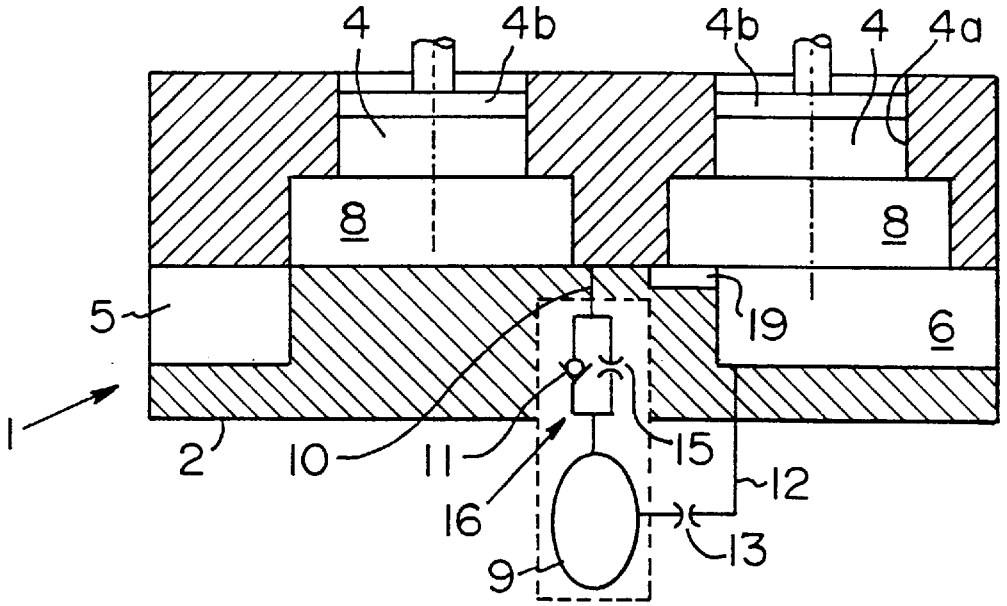

FIG. 4 illustrates an embodiment with a buffer element 9 which is in communication via a one-way restrictor valve 16 with the cylinder chamber 4 and also has a channel 12 which is in constant communication with the outlet side 6 to fill the buffer element 9. The filling behavior of the buffer element 9 can thereby be influenced by a suitable selection of the throttles 13 and 15.

Figure 5:
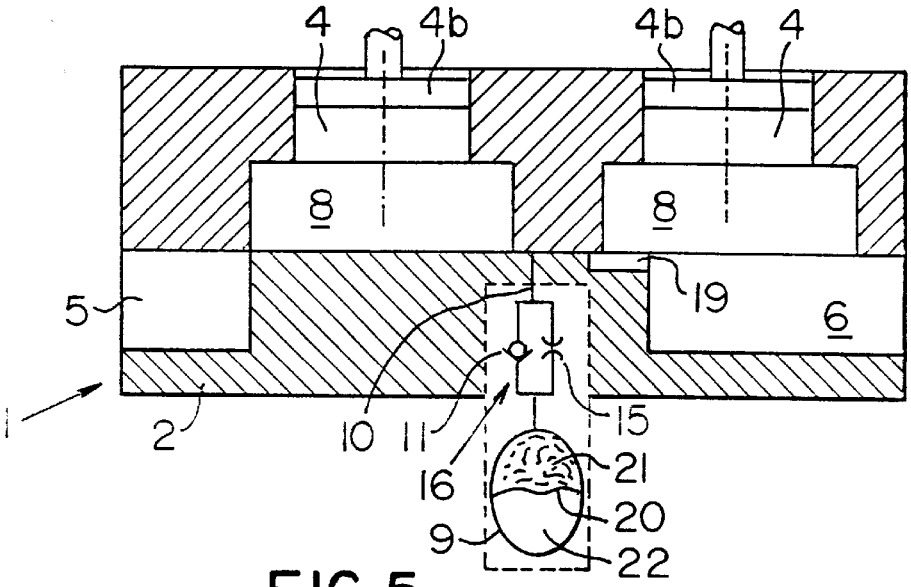

FIG. 5 illustrates an additional embodiment of the invention, whereby the buffer element 9 is a hydropneumatic buffer, e.g. in the form of a membrane buffer. A membrane 20 separates the buffer into two chambers, whereby a first chamber 21 is filled with hydraulic fluid and a second chamber 22 is filled with gas, e.g. nitrogen. With the same damping action, a buffer 9 which occupies a significantly smaller amount of space can be used. In this case, the hydropneumatic buffer is fed intermittently by the connecting channel 10 and a throttle 15 located in the connecting channel 10. It is also possible to provide a connecting channel and a throttle which are in constant communication with the control nodule 6.

Figure 6:
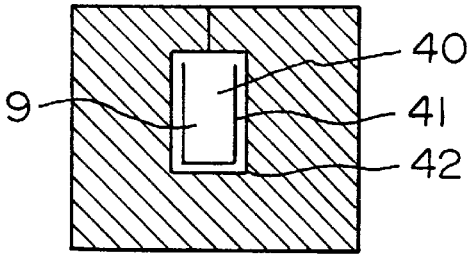
FIGS. 6 and 7 show embodiments of the buffer element.
Figure 7:
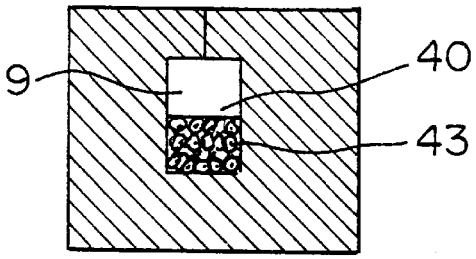

FIGS. 6 and 7 illustrate additional embodiments of the buffer element 9. In FIG. 6, the buffer element 9 is realized in the form of an oil-filled chamber 40 which is bounded by a flexible wall 41. The capacity of the buffer element 9 is thereby increased. If the flexible wall 41 is under a gas pressure from chamber 42, it is possible to further increase the capacity of the buffer element 9.

The buffer 9 illustrated in FIG. 7 has an oil-filled chamber 40 into which flexible elements 43 are inserted. These elements can be made of plastic, for example. The capacity of the buffer element 9 is increased, which results in a reduction of the amount of space required for the installation of the buffer 9 and in an improvement of the reversing actions compared to a buffer element filled with oil. The pulsations on the, positive displacement unit are thereby effectively reduced, as a result of which there are also fewer vibrations and less noise generated by the positive displacement unit.

Figure 8:
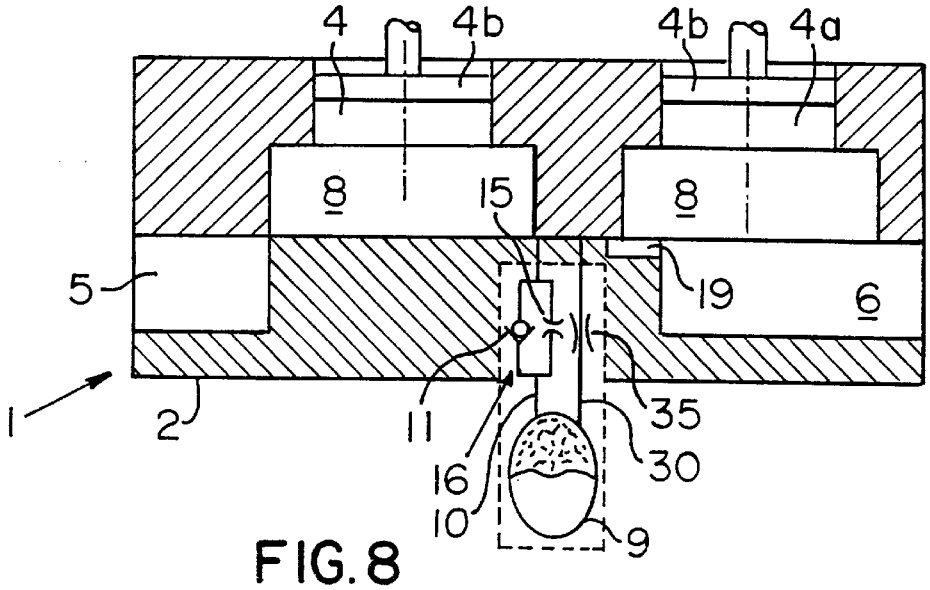
FIGS. 8 to 11 show views similar to those illustrated in FIG. 2 which are additional embodiments of the present invention which include a plurality of connecting channels.
Figure 9:
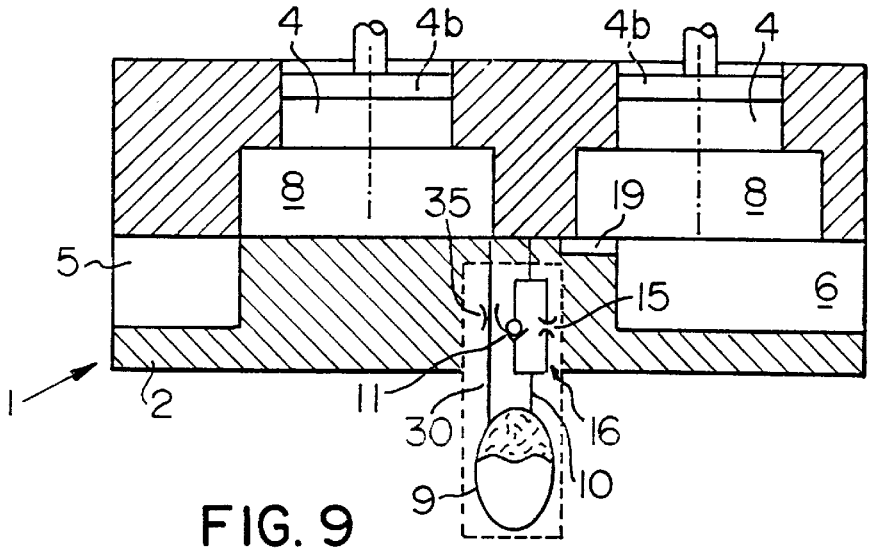
Figure 10:
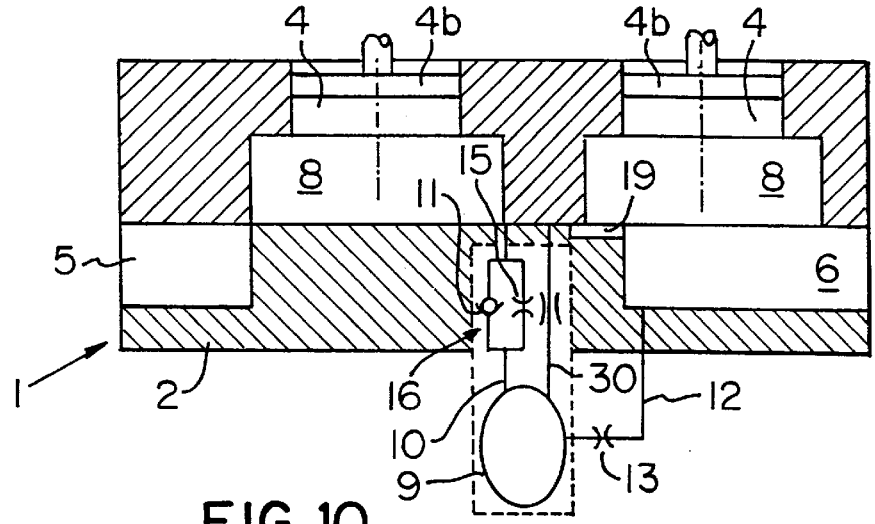
Figure 11:
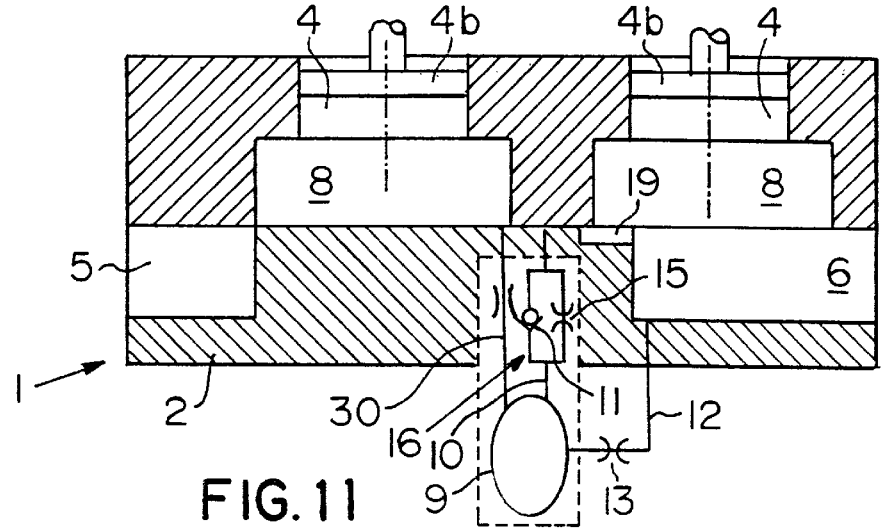

FIGS. 8 to 11 illustrate embodiments in which a plurality of connecting channels, e.g. two connecting channels 10 and 30, are connected to the buffer element 9 and are located in the control plate 2. In this case, the one-way restrictor valve 16 is located in the connecting channel 10, and an additional throttling device, such as a throttle 35 is located in channel 30. As a result of the reversal via a plurality of connecting channels 10, 30, the reversing action of the positive displacement unit is also significantly improved. The buffer element 9 in this case can be realized both as a buffer element with an increased capacity as illustrated in FIGS. 8 and 9 and as an oil-filled buffer as illustrated in FIGS. 10 and 11. In addition, the buffer element 9 can be in constant connection with the outlet side 6 via the channel 12 and the throttle 13 as in FIGS. 10 and 11, or in intermittent communication as in FIGS. 8 and 9. As a result of the use of a plurality of connecting channels 10, 30, the length of time which is available for filling the buffer element 9 and for equalizing the pressure of the cylinder chambers 4 is increased. The result is a further functional improvement in the reversing actions both when the positive displacement unit is operated as a pump and when it is operated as a motor. The pulsation is thereby effectively reduced, which in turn means that less noise and fewer vibrations occur on the positive displacement unit.

It will be apparent to those of ordinary skill in the art that various modifications may be made to the present invention without departing from the spirit and scope thereof. The scope of the present invention is defined by the appended claims and equivalents thereto.

We claim:

1. A device to reduce pulsations on a hydrostatic positive displacement unit which can be used both as a pump and as a motor in which at least one piston is mounted so that it can move longitudinally in a cylinder bore forming a cylinder chamber, the device including:

a buffer element which is in communication with a high-pressure side of the displacement unit and adapted to be brought into connection with the cylinder chambers of the displacement unit;

a connecting channel between the buffer element and the cylinder chamber; and a switchable valve located in the connecting channel.

2. The device as claimed in claim 1 wherein the switchable valve is a non-return valve opening toward the cylinder chamber.

3. The device as claimed in claim 1 wherein the connecting channel has two parallel channel segments, wherein the switchable valve is located in a first channel segment and a throttling device is located in a second channel segment.

4. The device as claimed in claim 1 wherein a throttle is positioned between the buffer element and the high pressure side of the displacement unit.

5. The device as claimed in claim 1 wherein the buffer element is a hydropneumatic buffer.

6. The device as claimed in claim 5 wherein the buffer element is a gas buffer with a membrane which separates a fluid space from a gas space.

7. The device as claimed in claim 1 wherein the buffer element has an oil-filled chamber with a flexible containment wall.

8. The device as claimed in claim 7 wherein the flexible wall is under a gas pressure.

9. The device as claimed in claim 1 wherein the buffer element has an oil-filled space, and flexible elements inserted into said space.

10. The device as claimed in claim 1 further including at least one additional connecting channel provided with a throttling device connecting the buffer element with the cylinder chambers.

11. The device as claimed in claim 3 wherein the throttling device is an orifice.

12. The device as claimed in claim 1 wherein the valve can be biased in a closed direction by a spring.

* * * * *